US006666486B1

(12) United States Patent
Fleming

(10) Patent No.: US 6,666,486 B1
(45) Date of Patent: Dec. 23, 2003

(54) SLIDE BOLT UNIT

(75) Inventor: Paul D. Fleming, Glendale, CA (US)

(73) Assignee: W & F Manufacturing, Sun Valley, CA (US)

( * ) Notice: Subject to any disclaimer, the term of this patent is extended or adjusted under 35 U.S.C. 154(b) by 153 days.

(21) Appl. No.: 09/668,530

(22) Filed: Sep. 21, 2000

(51) Int. Cl.[7] ..... E05C 1/04

(52) U.S. Cl. ..... 292/145; 292/147; 292/152; 292/DIG. 15

(58) Field of Search ..... 292/DIG. 21, 147, 292/145, 152, 153, 150, 175, 138, DIG. 15

(56) References Cited

U.S. PATENT DOCUMENTS

| | | | | | |
|---|---|---|---|---|---|
| 310,787 | A | * | 1/1885 | Buckley | |
| 1,207,600 | A | * | 12/1916 | Morgan | 292/181 |
| 1,510,562 | A | * | 10/1924 | Segal | 292/150 |
| 2,247,556 | A | * | 7/1941 | Lazarides | 292/152 |
| 3,806,175 | A | * | 4/1974 | Van Herpen | 292/147 |
| 4,058,332 | A | * | 11/1977 | Difazio | 292/147 |
| 4,159,838 | A | * | 7/1979 | Wilzig | 292/150 |
| 4,315,647 | A | * | 2/1982 | Wilzig | 292/143 |
| 5,290,077 | A | | 3/1994 | Fleming | |
| 6,045,167 | A | * | 4/2000 | Lauterbach | 292/62 |

FOREIGN PATENT DOCUMENTS

| | | | | |
|---|---|---|---|---|
| DE | WO 98/17885 | * | 4/1998 | E05C/7/06 |

* cited by examiner

*Primary Examiner*—Gary Estremsky
(74) *Attorney, Agent, or Firm*—Kelly Bauersfeld Lowry & Kelley, LLP

(57) ABSTRACT

A slide bolt unit is provided for releasibly locking a door or window or the like, such as a semi-active door in a double door entry set. The slide bolt unit includes an elongated slide bolt carried by a channel-shaped housing adapted for recessed mounting into a side edge of a door or the like. An actuator tab on the slide bolt is exposed through a position control slot formed in the housing for fingertip actuation to displace the slide bolt between an advanced position engaging a keeper on an adjacent header or sill or the like to lock the door in a closed position, and a retracted position to permit door opening. The actuator tab has a slotted profile defining lock shoulders biased by a spring for releasibly engaging and locking with the housing at opposite ends of the position control slot, and a narrowed central slide track for alignment with the position control slot upon fingertip depression of the actuator tab to permit quick and easy sliding displacement of the actuator tab along the position control slot from one end to the other.

43 Claims, 8 Drawing Sheets

FIG. 3
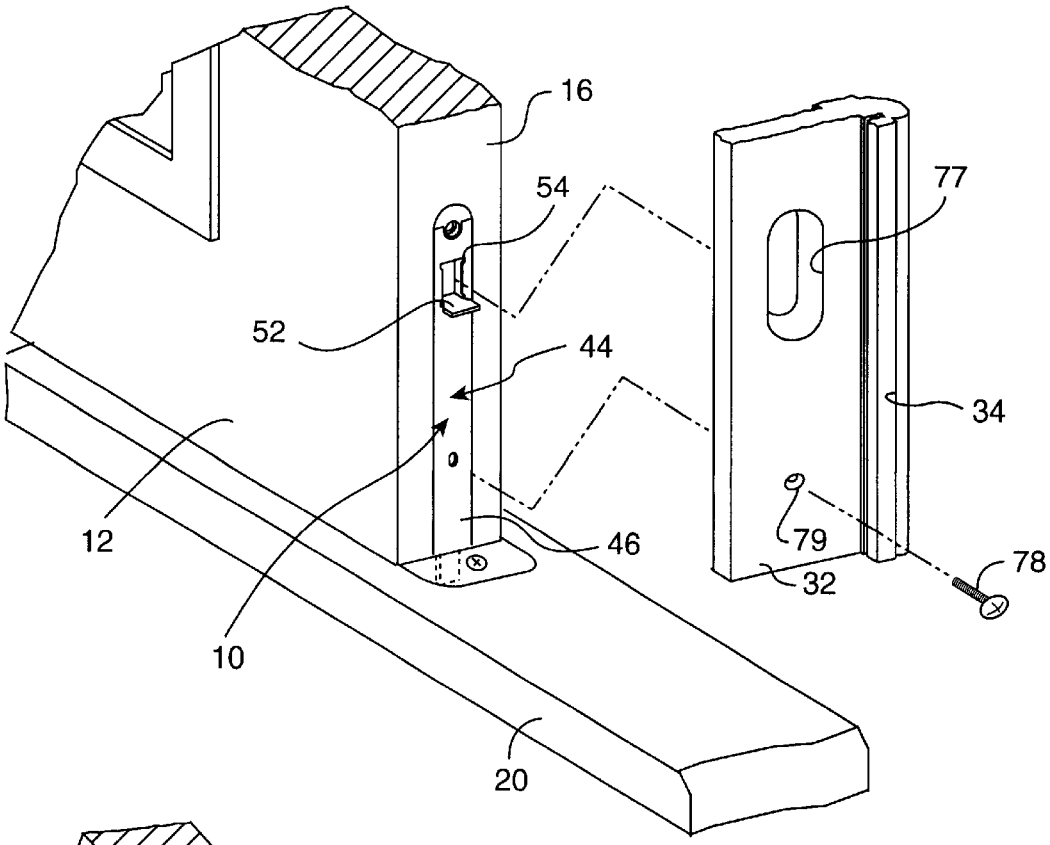
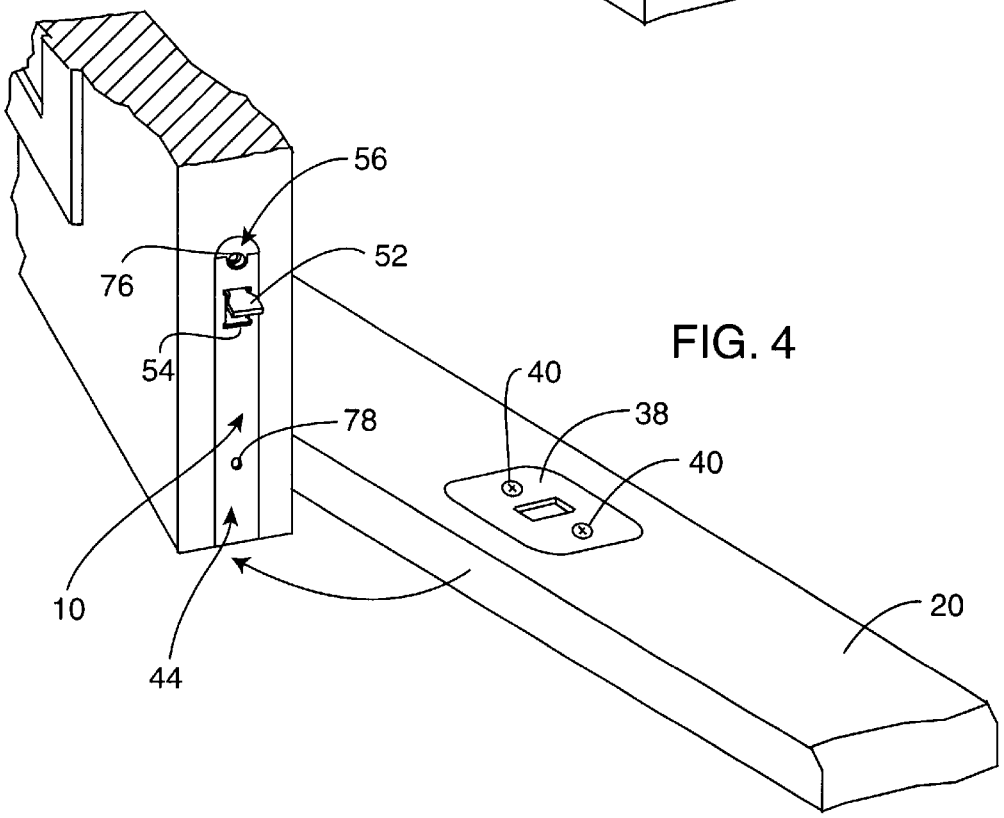
FIG. 4

SLIDE BOLT UNIT

BACKGROUND OF THE INVENTION

This invention relates generally to an improved lock assembly for secure and releasible locking of a door or window or the like, particularly such as releasible locking of a semi-active door in a double door entry set. More specifically, this invention relates to an improved lock assembly having a slide bolt adapted for quick and easy fingertip actuation for displacement between an advanced locked position and a retracted unlocked position.

A typical double door entry set includes a primary door intended for routine opening and closing movement in the course of normal ingress and egress, in combination with a secondary or so-called semi-active door which is normally retained in a closed and locked condition. The primary door is normally equipped with door hardware including door handles or other suitable actuator devices for operating retractable door latch and deadbolt devices which commonly engage appropriate keepers mounted on the adjacent free side edge of the semi-active door. In turn, the semi-active door is normally equipped with locking hardware mounted at or near the free side edge thereof, generally proximate the upper and lower ends of the semi-active door, including retractable slide bolts for engaging appropriate keepers mounted respectively at the door header and sill. The slide bolts are normally advanced to a locked position engaging their respective keepers to retain the semi-active door normally in a closed and locked condition. However, when and if desired, these slide bolts can be retracted for disengagement from their respective keepers to unlock the semi-active door and permit opening thereof. In a common design, the slide bolts are exposed along the free side edge of the semi-active door for manual sliding displacement from the advanced locked position to the retracted unlocked position only when the primary door is open.

In the past, header/sill locking devices for a semi-active door of a double door entry set have generally comprised a simple slide bolt mounted in a track for sliding movement between the advanced and retracted positions, with frictional resistance between the slide bolt and track serving to retain the slide bolt in the selected advanced or retracted position. With this design, however, substantial frictional resistance sufficient to securely retain the slide bolt in the selected position of adjustment can result in a device that is difficult to operate manually. Reduced frictional resistance facilitates manual displacement of the slide bolt, but may result in reduced locking security by permitting undesired movement of the slide bolt to the retracted unlocked position in response to vibratory forces applied to the door. Such vibratory forces can be attributable to strong gusty winds, repeated shock forces from closure of the primary door, and/or an unauthorized intruder.

Improved security lock devices for header/sill locking of a semi-active door have been developed with a view toward overcoming these problems and disadvantages. See, for example, U.S. Pat. No. 5,290,077 which discloses and describes a header/sill lock assembly having elongated header and sill lock pins driven in unison between advanced locking positions and retracted unlocking positions in response to rotation of a thumbturn mounted near the free side edge of the semi-active door at an inner or indoor side thereof. While this header/sill locking arrangement beneficially provides significantly enhanced security locking of the semi-active door, the mechanism extends the entire height of the door and includes a significant number of parts to result in a device that is relatively complex and costly.

There exists a need for further improvements in and to security lock devices of the type designed for header/sill locking of a semi-active door or the like, particularly with respect to providing a relatively compact and mechanically simple device suited for quick and easy installation, and for correspondingly simple yet reliable operation while providing high security releasible locking of the door. The present invention fulfills these needs and provides further related advantages.

SUMMARY OF THE INVENTION

In accordance with the invention, an improved slide bolt unit is provided for releasibly locking a door or window or the like, such as a semi-active door in a double door entry set. The slide bolt unit comprises a compact and relatively simple lock assembly constructed from a relative minimum number of parts to include an elongated slide bolt adapted for quick and easy fingertip actuation for displacement with relatively low friction between an advanced position engaging a keeper on an adjacent header or sill or the like to lock the door in a closed position, and a retracted position to permit door opening. In the advanced and retracted positions, the slide bolt unit includes means for releasibly retaining the slide bolt in place.

In the preferred form, the slide bolt is carried by a channel-shaped housing adapted for recessed mounting into a side edge of a door or the like. A laterally turned actuator tab on the slide bolt is exposed through a position control slot formed in the housing for fingertip access at the door side edge. The actuator tab has a slotted profile defining lock shoulders biased by a spring for normally locking with the housing by seating within one of a pair of relatively wide pockets formed respectively at the opposite ends of the position control slot, corresponding respectively with the advanced and retracted positions of the slide bolt. The actuator tab further defines a narrowed central track having a width less than the lock shoulders thereon for alignment with a narrowed central segment of the position control slot upon fingertip depression of the actuator tab against the spring to permit quick and easy sliding displacement of the actuator tab along the position control slot from one end to the other. In the preferred form, the spring is formed integrally with a first end cap mounted at one end of the channel-shaped housing. A second end cap mounted at an opposite end of the housing defines a slide port for relatively low friction sliding displacement of the slide bolt between the advanced and retracted positions.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is an enlarged fragmented perspective view similar to FIG. 2, and shown in partially exploded form to reveal the slide bolt unit of the present invention installed into a side edge of the semi-active door generally at a lower or sill end thereof, and depicting the slide bolt unit with a slide bolt thereof in an advanced position for retaining the semi-active door locked in the closed position;

FIG. 4 is an enlarged fragmented perspective view similar to FIG. 3, but showing the slide bolt of the slide bolt unit in a retracted position to permit opening of the semi-active door;

DETAILED DESCRIPTION OF THE PREFERRED EMBODIMENT

Figure 1:
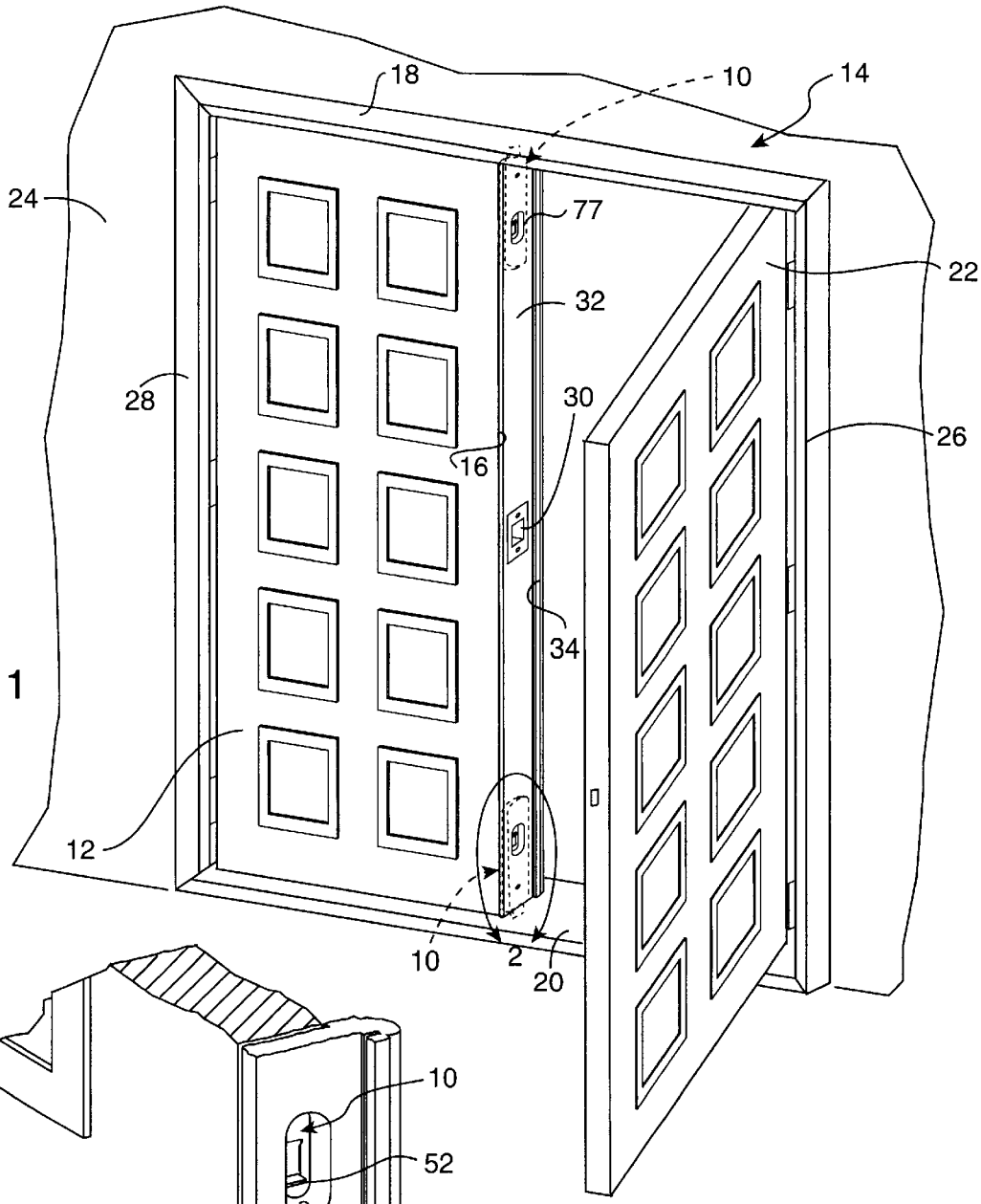
FIG. 1 is a fragmented perspective view illustrating a double door entry set including a primary door shown in an open position and a semi-active door shown in a closed position, wherein the semi-active door is locked in the closed position at the header and sill thereof by a pair of slide bolt units constructed in accordance with the present invention.

As shown in the exemplary drawings, an improved slide bolt unit referred to generally by the reference numeral 10 in FIGS. 1–7 is provided for releasible high security locking of a semi-active door 12 of a double door entry set 14. As shown in FIG. 1, a pair of the slide bolt units 10 of the present invention are mounted along the free side edge 16 of the semi-active door 12 at positions respectively near the header 18 and sill 20 for releasibly locking the door 12 in a closed position. The slide bolt units 10 are suitably exposed upon movement of a related primary door 22 to an open position to permit access to and operation of the slide bolt units 10 to unlock the semi-active door 12, when and if desired.

Figure 2:
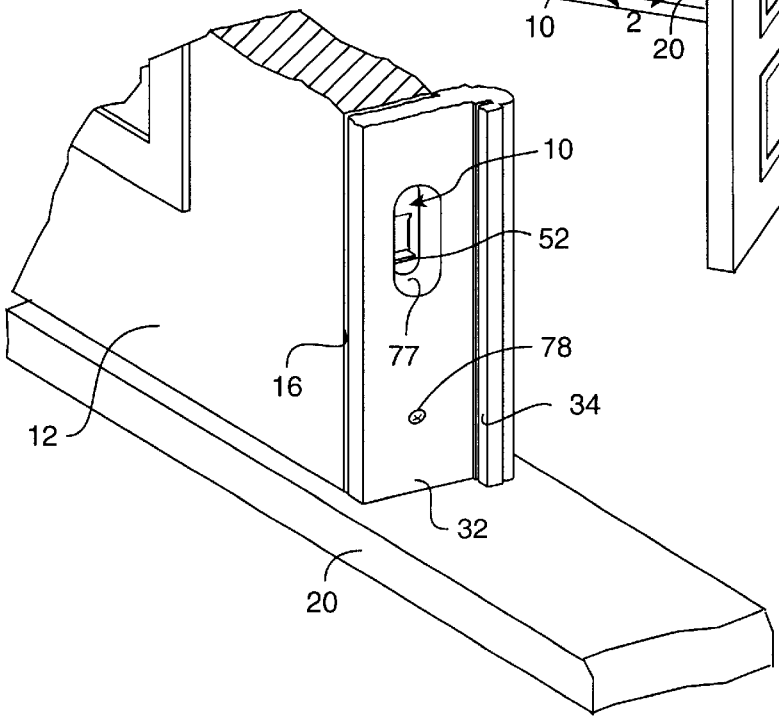
FIG. 2 is an enlarged fragmented perspective view corresponding with the encircled region 2 of FIG. 1.

As shown in FIG. 1, the double door entry set 14 comprises a door frame mounted within a suitable opening in a building wall 24 to define an opposed pair of doorjambs 26 and 28 extending vertically between the upper header 18 and the lower sill or threshold 20. The primary door 22 is hingedly supported by the door jamb 26 and includes appropriate door latch and/or deadbolt hardware (not shown) for engaging one or more strike sets or keepers 30 mounted centrally along the free side edge 16 of the associated semi-active door. In turn, the semi-active door 12 is hingedly supported at one side from the opposite door jamb 28 and is normally retained by the upper and lower slide bolt units 10 in a closed and locked condition. A trim strip or astragal 32 is normally mounted on the free side edge 16 of the semi-active door 12, opposite the hinged side, and provides a convenient laterally projecting door stop surface 34 for the primary door 22 in the closed position (FIGS. 1–3).

Figure 5:
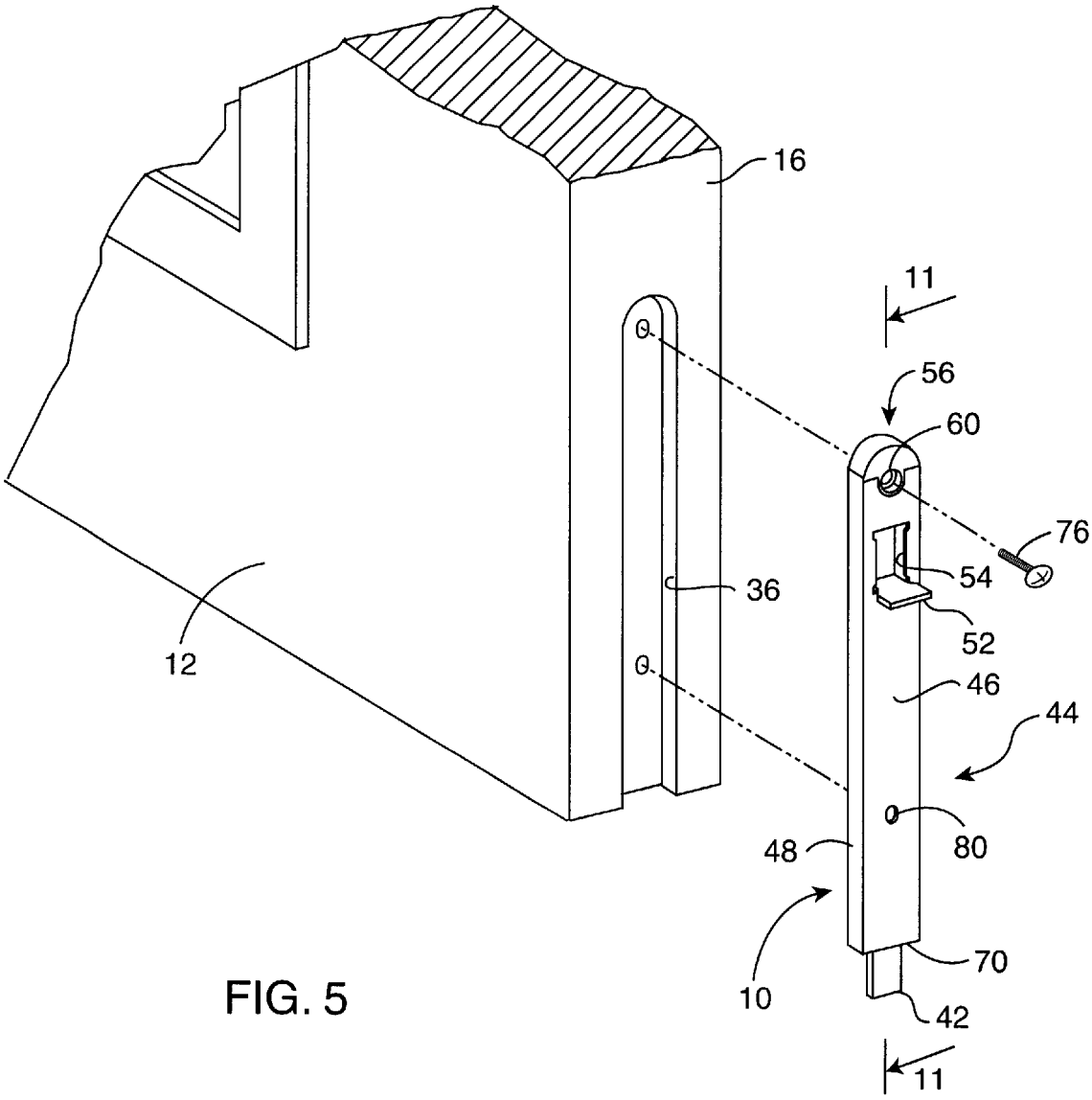
FIG. 5 is a fragmented perspective view illustrating the slide bolt unit in exploded relation with the semi-active door.
Figure 6:
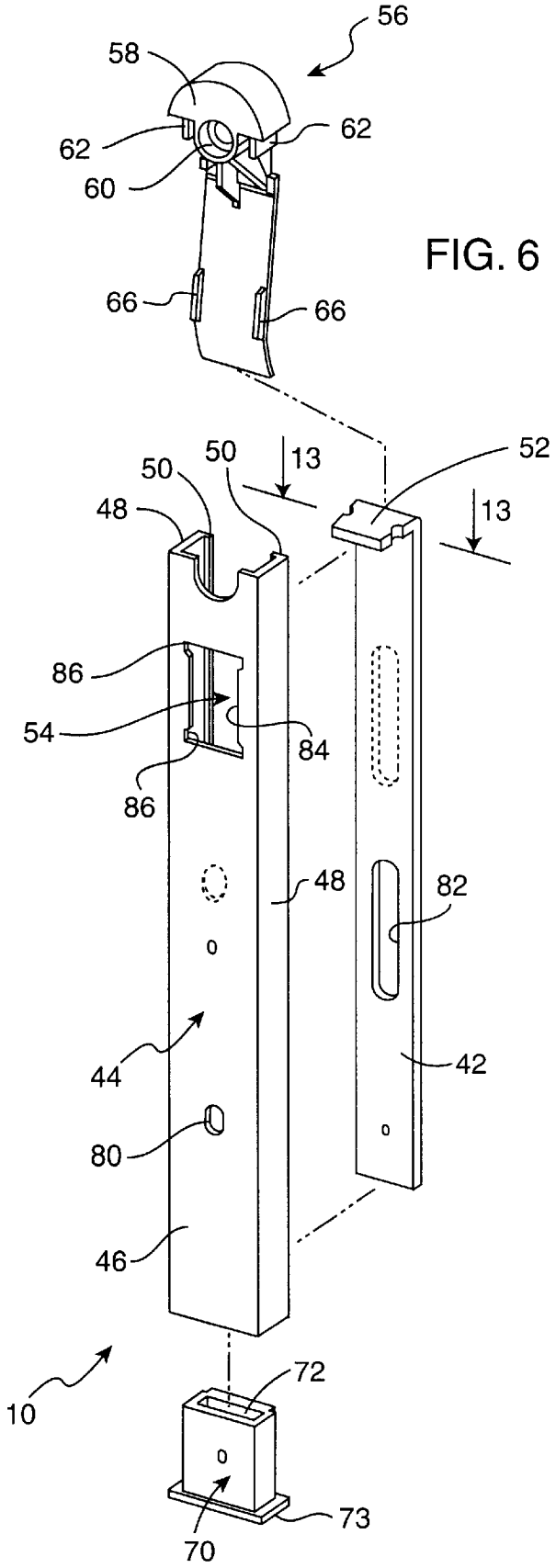
FIG. 6 is an exploded front perspective view of the slide bolt unit, depicting assembly of the components thereof.
Figure 7:
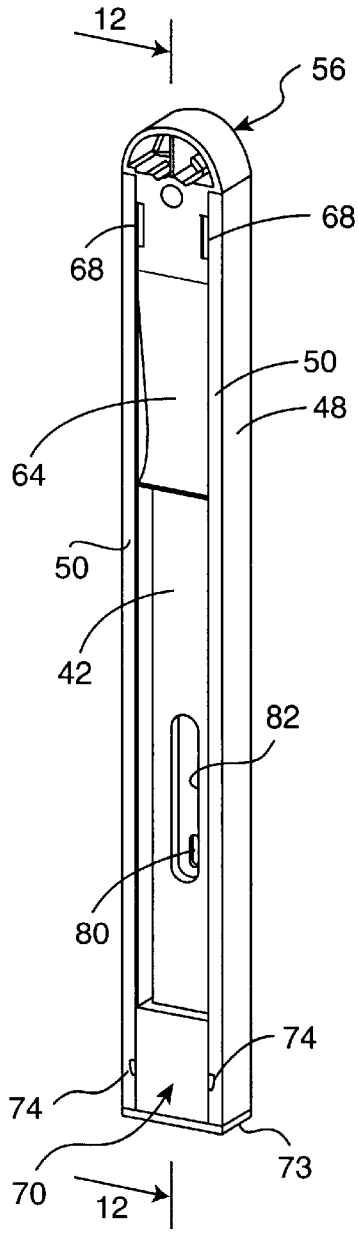
FIG. 7 is a rear perspective view of the assembled slide bolt unit.
Figure 8:
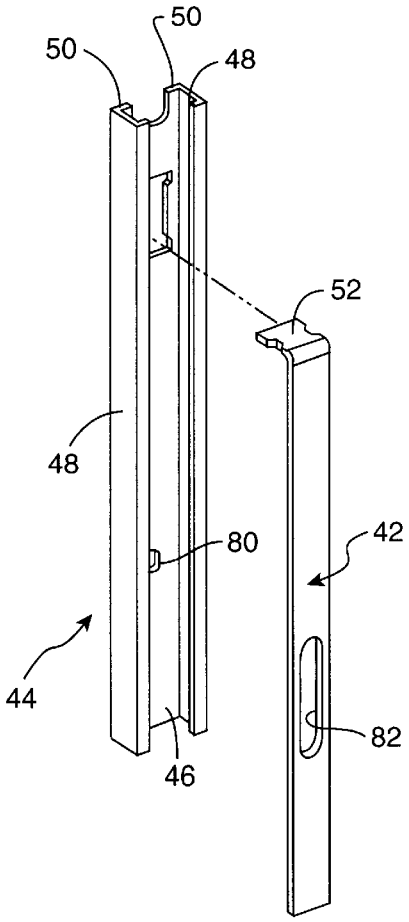
FIG. 8 is a rear perspective view showing assembly of the slide bolt into a rearwardly open channel-shaped housing member.
Figure 9:
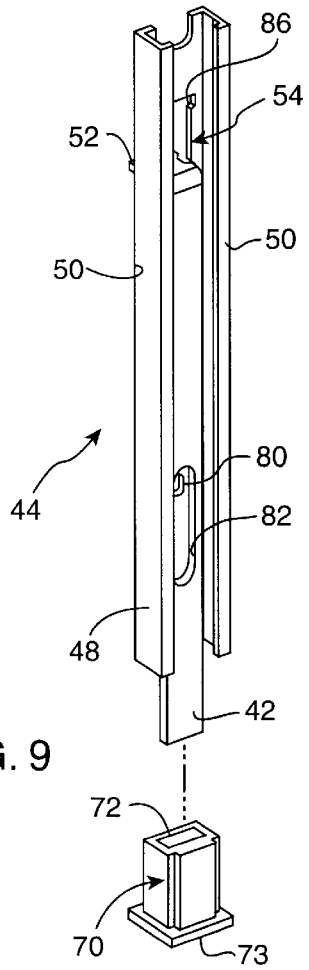
FIG. 9 is a rear perspective view similar to FIG. 8, but depicting further assembly of the slide bolt unit including mounting of a ported end cap onto one end of the channel-shaped housing member.
Figure 10:
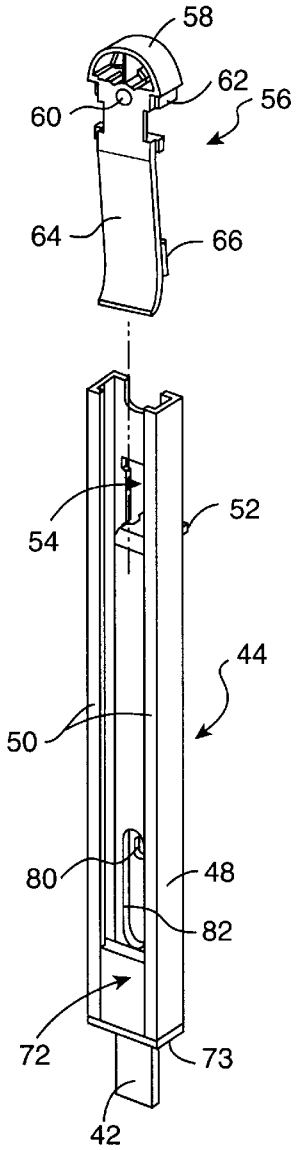
FIG. 10 is a rear perspective view similar to FIG. 9, and showing further assembly of the slide bolt unit including mounting of a spring end cap onto an opposite end of the channel-shaped housing member.
Figure 11:
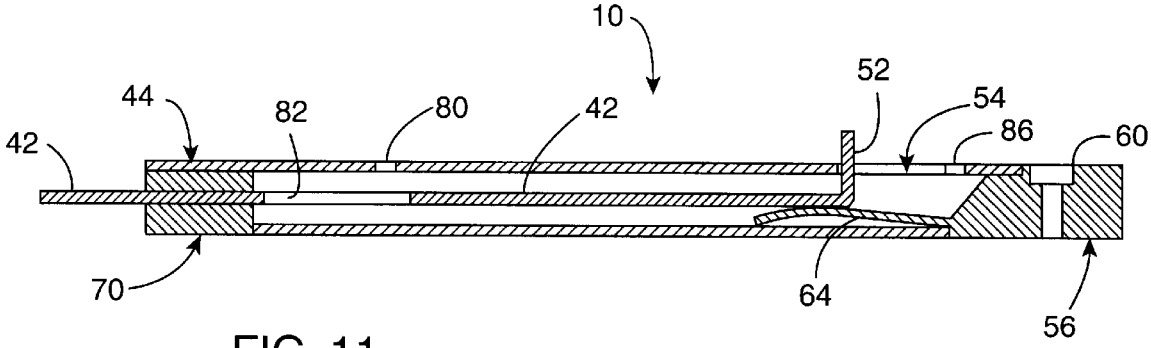
FIG. 11 is an enlarged vertical sectional view taken generally on the line 11—11 of FIG. 5.
Figure 12:
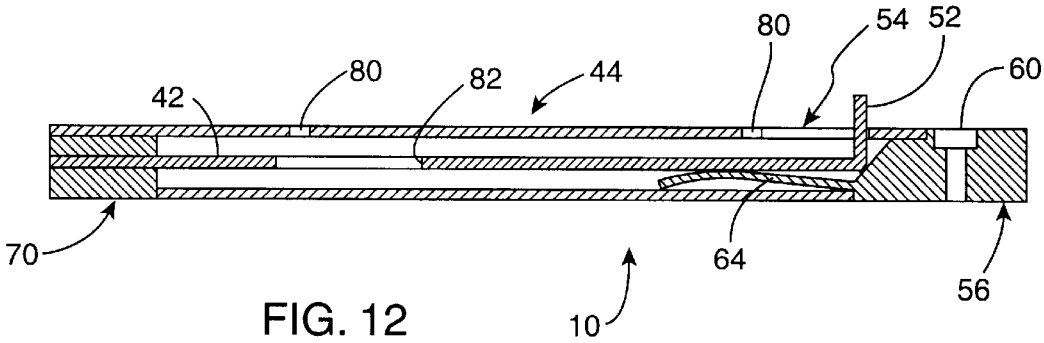
FIG. 12 is an enlarged vertical sectional view taken generally on the line 12—12 of FIG. 7.

The improved slide bolt unit 10 of the present invention generally comprises a compact cartridge-like assembly having a size and shape for nested or recessed mounting into a matingly shaped channel 36 formed in the free side edge 16 of the semi-active door 12, as viewed best in FIG. 5. In this regard, FIGS. 3–5 illustrate construction details for a single slide bolt unit 10 mounted into the side edge 16 of the semi-active door 12 generally at the lower or sill end thereof, for releasible locking engagement as will be described in more detail with a ported keeper plate 38 or the like (FIG. 4) mounted as by screws 40 onto the sill 20. It will be recognized and understood that a similar second slide bolt unit 10 is mounted into the door side edge 16 generally at the upper or header end thereof (as viewed in FIG. 1) for releasible locking engagement with a similar keeper plate (not shown) mounted onto the header 18. In each case, the recessed channel 36 may be formed conveniently as a simple router-cut recess, and the cartridge-shaped slide bolt unit 10 is configured to substantially fill this channel 36 in a nested and flush manner.

The illustrative slide bolt unit 10 generally comprises an elongated slide bolt 42 (FIGS. 6–10) having a generally strip-like configuration and constructed from a suitable hard and rugged material such as a tool steel. The slide bolt 42 has a size and shape for sliding reception into a hollow cartridge-like or channel-shaped housing 44 shown in the form of an elongated channel member having a front face 46 joined along opposite sides to a pair of rearwardly extending side legs 48 having short in-turned flanges 50 at the rear-most ends thereof. Thus, the channel-shaped housing 44 defines an open-ended and rearwardly open structure forming an elongated internal slide channel for slide-fit reception of the slide bolt 42. One end of the slide bolt 42 is turned laterally in a forward direction to form an actuator tab 52 projecting forwardly through an open position control slot 54 formed in the front face 46 of the housing 44 near one end thereof.

A first end cap or spring cap 56, which can be formed conveniently from molded plastic or like, is sized and shaped for snug press-fit reception into the open end of the channel housing 44 adjacent the position control slot 54. More particularly, as shown best in FIGS. 6–7 and 10–12, this first end cap 56 comprises a generally semicircular-shaped body 58 defining an open screw port 60, and joined to a pair of spaced-apart guide ribs 62 sized for press-fit reception into the open end of the channel housing 44. In addition, the first end cap 56 includes and carries a leaf spring 64 extending into the channel-shaped housing 44, and having a width at a tip or distal end to seat firmly against the inboard surfaces of the inturned flanges 50 at the rear of the housing 44. A central region of the leaf spring 64 is bowed forwardly to bear against a rear side of the slide bolt 42 to urge the slide bolt forwardly within the slide channel against the rear or blind side of the housing front face 46. A pair of laterally spaced slide rails 66 extend forwardly from the opposite side edges of the leaf spring 64 to contact the slide bolt 42 in a manner providing limited or minimal running surface engagement therewith. After installation of the first end cap 56, the rear flanges 50 on the channel housing 44 can be staked or detented as indicated by reference numeral 68 in FIG. 7, to lock the end cap in place. In the preferred form, the spring cap 56 inclusive of the leaf spring 64 is formed as an integrally molded unit.

A second end cap or slide cap 70, which may also be formed from a suitable molded plastic or the like, is provided for snug press-fit reception into the opposite end of the channel housing 42. This second end cap 70 generally comprises a rectangular plug defining a rectangular slide port 72 for relatively low friction sliding reception of the end of the slide bolt 42 opposite the actuator tab 52. A leading or inboard end of the slide cap 70 may be beveled for quick and easy press-fit reception into the channel housing 42, and a cap flange or plate 73 (FIG. 6) is formed at the trailing end thereof for closely overlying the housing end to provide a finished look. After installation of the second end cap 70, the rear flanges 50 of the channel housing 44 can be staked or detented as indicated by reference numeral 74 in FIG. 7, to lock the end cap in place.

The thus-assembled slide bolt unit 10, comprising the slide bolt 42 with actuator tab 52 thereon, the channel housing 44, and the two end caps 56 and 70, constitutes a compact cartridge-like assembly for nested and flush mounting into the matingly shaped channel 36 formed in the door side edge 16 (shown best in FIG. 5). A single screw 76 can be fastened through the screw port 60 in the first end cap 56 to lock the slide bolt unit 10 in place, with the actuator tab 52 projecting laterally outwardly with respect to the door side edge 16. The associated trim strip or astragal 32 can then be mounted onto the door side edge 16 in a position to substantially overlie the slide bolt unit 10, with the actuator tab 52 recessed but otherwise exposed for fingertip access within an elongated access port 77 formed in the trim strip 32 (FIGS. 2–3). In this regard, the trim strip 32 is normally mounted onto the door side edge 16 by one or more mounting screws 78, wherein one of the screws 78 can be fastened into the door side edge through a screw port 79 in the trim strip and further through an open screw port 80 formed in the front face 46 of the channel housing 44 (FIGS. 2–3). Importantly, this mounting screw 78 extends through an elongated vertical slot 82 formed in the slide bolt 42 (FIGS. 6–12) so that secure mounting of the slide bolt unit 10 and overlying trim strip 32 does not obstruct sliding movement of the slide bolt 42 between the advanced and retracted positions.

Figure 13:
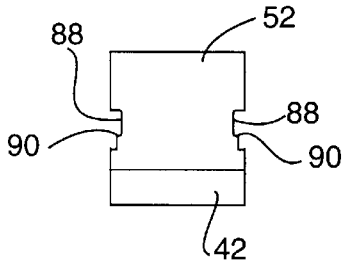
FIG. 13 is an enlarged end view of the slide bolt taken generally on the line 13—13 of FIG. 6, and illustrating construction details of an actuator tab formed at one end of the slide bolt.

Displacement of the slide bolt 42 between the advanced and retracted positions is regulated by the actuator tab 52 which has a slotted or contoured profile chosen for controlled interfit with the position control slot 54. More particularly, as shown best in FIGS. 3–6, 8–10 and 14–16, the position control slot 54 has a narrow width central segment 84 defined by generally parallel slot edges extending between relatively short but comparatively wider opposite end segments or notches 86. The slotted profile of the actuator tab 52 (shown best in FIG. 13) defines a narrow width central track 88 sized to permit sliding movement along the narrow central segment 84 of the position control slot 54, when the actuator tab 52 is pressed inwardly relative to the channel housing 44 to align the tab track 88 with the longitudinal edge margins of the slot central segment 84. The slotted profile of the actuator tab 52 additionally defines a pair of comparatively wider lock shoulders 90 underlying the central track 88, wherein these lock shoulders 90 cooperatively define an actuator tab width greater that the slot central segment 84 but sufficiently narrow for reception into either one of the wider slot end notches 86.

Figure 14:
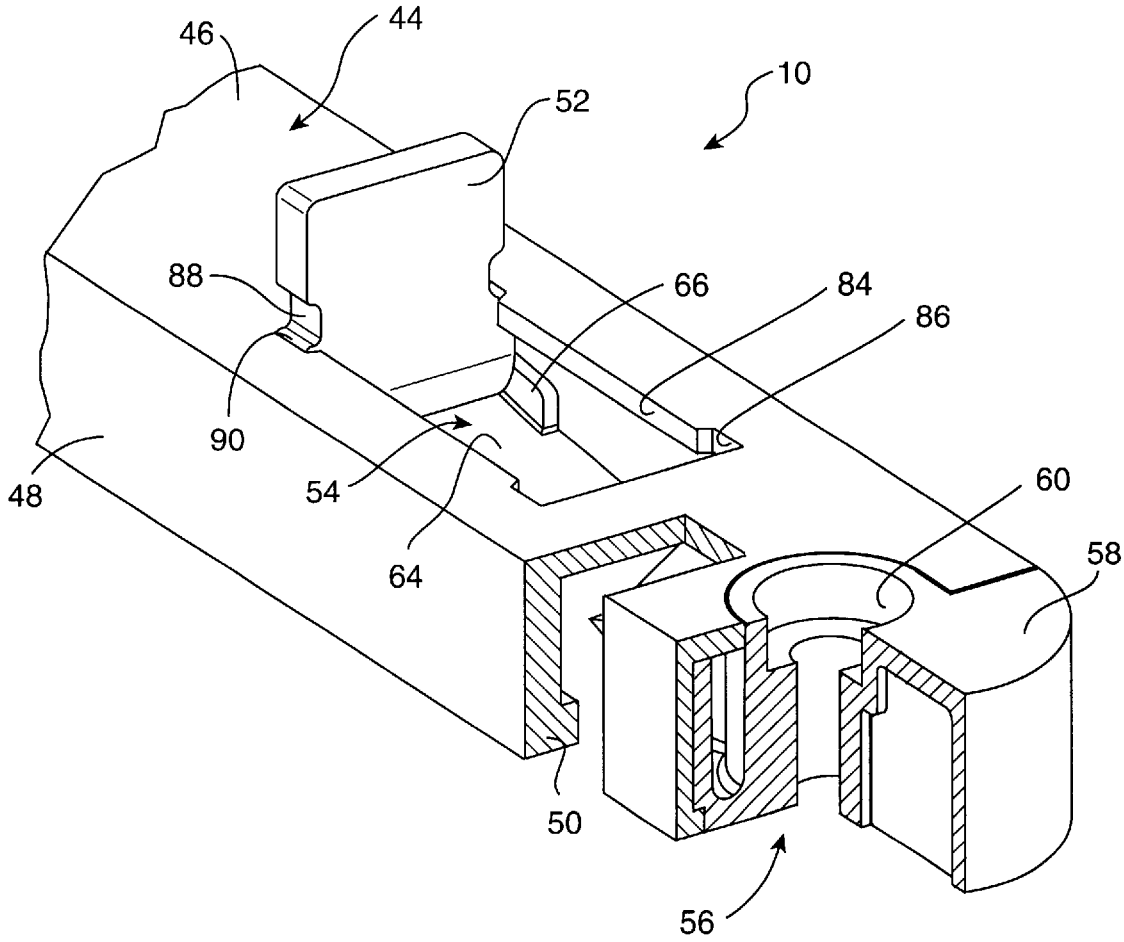
FIG. 14 is an enlarged and fragmented perspective view showing the slide bolt unit with the actuator tab releasibly locked in a first position to retain the slide bolt in the advanced position.
Figure 15:
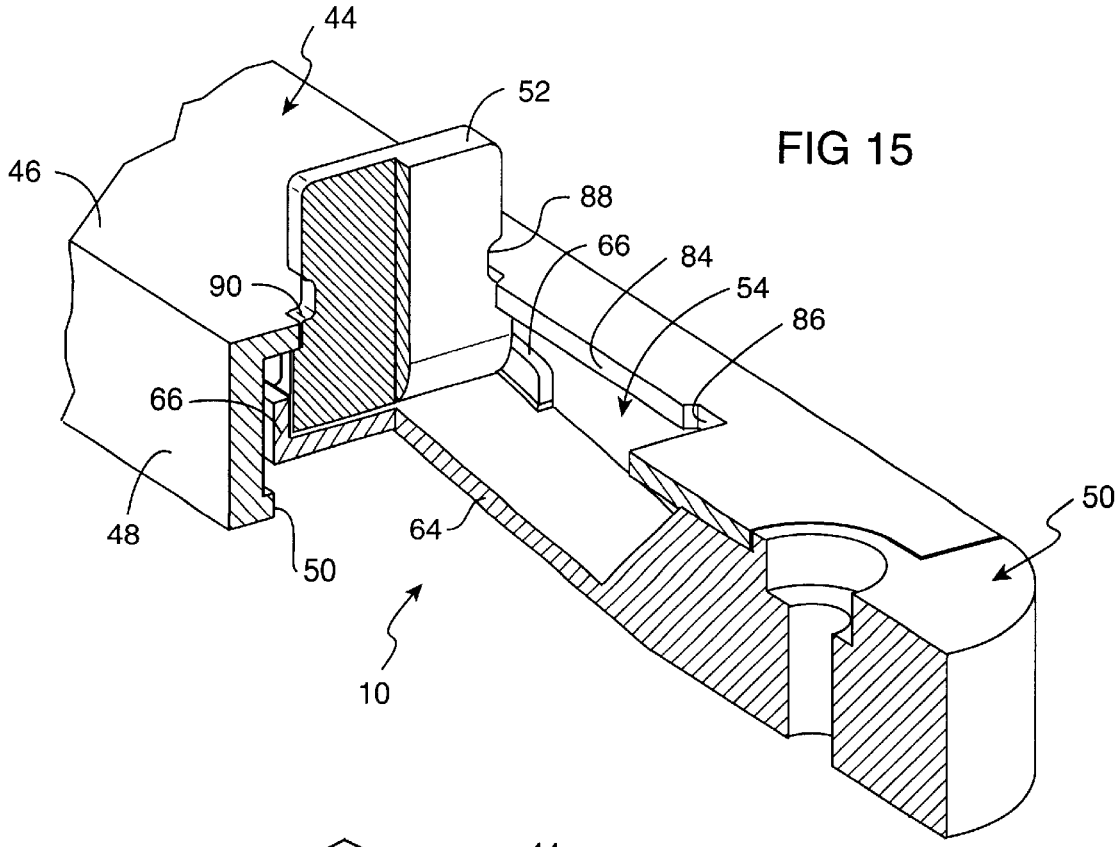
FIG. 15 is an enlarged and fragmented perspective view similar to FIG. 14, illustrating the actuator tab locked in the first position.
Figure 16:
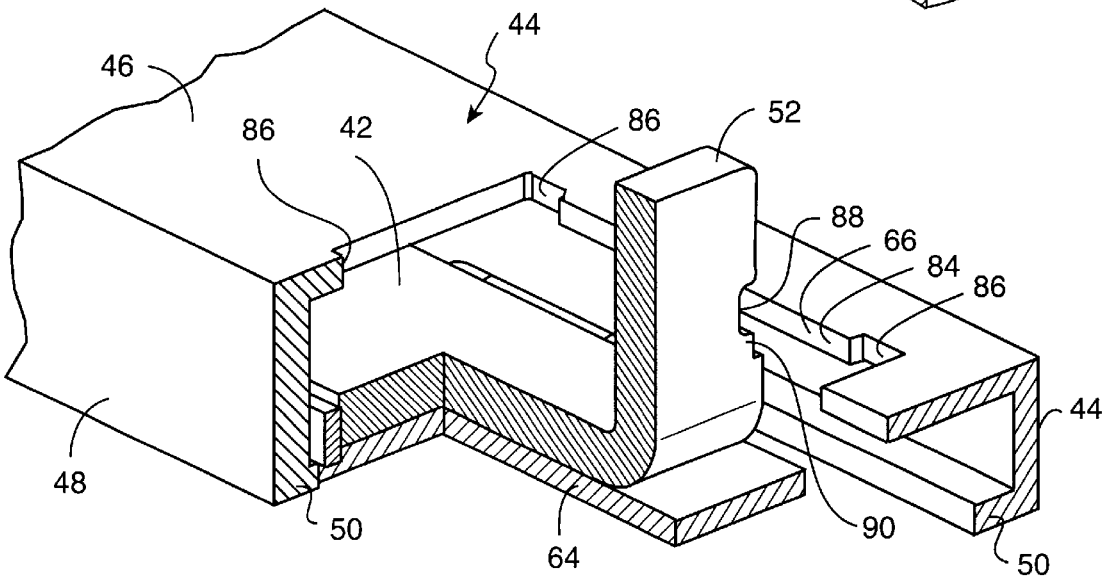
FIG. 16 is an enlarged and fragmented perspective view similar to FIGS. 14–15, but showing depression of the actuator tab to permit sliding displacement of the slide bolt between the advanced and retracted positions.

Importantly, the leaf spring 64 on the spring cap 56 bears against the rear side of the slide bolt 42 at a location longitudinally between the actuator tab 52 and the slide cap 70 for urging or biasing the actuator tab 52 in a forward direction within the housing 44 relative to the position control slot 54. Accordingly, when the slide bolt 42 is in a position wherein the actuator tab 52 is aligned with either one of the wider slot end notches 86 of the position control slot 54, corresponding respectively with the advanced or retracted positions of the slide bolt 42, the leaf spring 64 urges the lock shoulders 90 into the aligned slot end notch 86 to lock the actuator tab 52 and the associated slide bolt 42 in place. FIGS. 14–15 show the actuator tab 52 with its lock shoulders 90 engaging the slot end notch 86 associated with the slide bolt 42 in an advanced position protruding from the slide end cap 70 to engage and lock with the associated keeper plate 38. As shown, the lock shoulders 90 protrude into the plane of the position control slot 54, and define a transverse width sufficient to block displacement or translation of the actuator tab 52 along the narrower central segment 84 of the position control slot 54.

When it is desired to shift the lock bolt 42 from the advanced locking position to the retracted position, or vise versa, the actuator tab 52 can be depressed quickly and easily with fingertip pressure to push the lock shoulders 90 thereon out of alignment with the associated widened end notch 86 of the position control slot 54, and to orient the narrower tab track 88 into coplanar alignment with the slot 54. In this position, as viewed in FIG. 16, the actuator tab 52 can be shifted manually with relatively minimal fingertip pressure to displace the slide bolt 42 from the advanced position to the retracted position, or vice versa. During such displacement, the lock shoulders 90 are urged by the spring 64 into sliding and running engagement with the blind side of the housing front panel 46 along the side margins of the position control slot 54 to provide relatively a small surface contact area with correspondingly minimal running friction therebetween. In addition, the slide rails 66 on the leaf spring 64 contact the rear side of the slide bolt 42 for substantially minimized running friction therebetween. When the actuator tab 52 is displaced to the opposite end of the position control slot 54, into alignment with the widened end notch 86 at said opposite end, the leaf spring 64 again urges the actuator tab 52 forwardly relative to the slot 54 for re-engaging the tab lock shoulders 90 with the widened slot notch 86. This results in re-locking the position of the slide bolt 42 in the selected retracted or advanced position until the actuator tab 52 is subsequently depressed and shifted along the position control slot 54 back to the opposite end thereof.

The improved slide bolt unit 10 of the present invention thus provides a relatively simple device adapted for quick and easy assembly from a minimum number of components, and for quick and easy fingertip operation to displace the slide bolt 42 between the advanced locked position and the retracted unlocked position. The slide bolt 42 is configured to extend generally in a plane that is transverse to a direction of initial opening movement of the door, whereby the slide bolt 42 has the capacity to retain the door in a securely locked condition in the presence of relatively strong forces such as hurricane force winds acting on the door. The releasibly locked engagement of the slide bolt 42 in the advanced position additionally enhances locking security by minimizing risk of inadvertent slide bolt retraction in response to vibratory or other forces applied to the door. However, the slide bolt can be displaced quickly and easily between the advanced and retracted position with a simple fingertip actuation, and with relatively minimal running friction between the moving parts. The improved slide bolt unit 10 can be mounted reversibly at a door header or sill, or in a right-hand or left-hand orientation, without requiring component modification.

A variety of further modifications and improvements in and to the slide bolt assembly of the present invention will be apparent to those persons skilled in the art. For example, while the invention is shown and described in the form of separately actuated header and sill lock units for a semi-active door in a double door entry set, it will be recognized that this pair of lock units may be actuated in unison by a common actuator of the type described in U.S. Pat. No. 5,290,077. Moreover, is will be appreciated that the slide bolt unit of the present invention may be utilized singly or in multiples in other panel-type door and window applications, and in a variety of vertically and horizontally extending orientations, for releasibly locking a hinged panel or the like in a normally closed position. Accordingly, no limitation on the invention is intended by way of the foregoing description and accompanying drawings, except as set forth in the appended claims.

What is claimed is:

1. A slide bolt unit for releasibly locking a door or the like in a closed position, said slide bolt unit comprising:

a housing defining an elongated slide channel;

an elongated slide bolt carried by said housing for sliding movement along said slide channel between advanced and retracted positions for respectively locking and unlocking the door;

an end cap mounted on said housing at one end thereof, said end cap defining a slide port for slide-through reception of said slide bolt;

an actuator tab carried by said slide bolt and extending laterally therefrom through a position control slot formed in said housing, said actuator tab being movable between a first position engageable with said housing to prevent slide movement of said actuator tab along said position control slot to correspondingly prevent displacement of said slide bolt along said slide channel, and a second position slidably movable along said position control slot for displacing said slide bolt along said slide channel between said advanced and retracted positions; and spring means for urging said actuator tab normally to said first position, said actuator tab being manually operable by fingertip depression for displacement from said first position to said second position, and for manually displacing said actuator tab while in said second position along said position control slot;

said position control slot defining an elongated central slot segment extending between a pair of comparatively wider notches formed at opposite ends thereof, and wherein said actuator tab defines at least one lock shoulder for engaging an associated one of said notches when said actuator tab is in said first position, said actuator tab further defining a relatively narrow slotted track sized to permit sliding movement of said actuator tab along said central slot segment when said actuator tab is in said second position, and further wherein said spring means urges said at least one lock shoulder into sliding engagement with said housing during movement of said slide bolt between said advanced and retracted positions to provide a relatively small surface contact area with correspondingly minimal running friction therebetween.

2. The slide bolt unit of claim 1 wherein said actuator tab is formed integrally with said slide bolt.

3. The slide bolt unit of claim 1 wherein said actuator tab defines a pair of said lock shoulders for engaging an associated one of said notches when said actuator tab is in said first position.

4. The slide bolt unit of claim 1 wherein said spring means biases said actuator tab in a direction for seating said at least one lock shoulder into an associated one of said notches.

5. The slide bolt unit of claim 1 wherein said end cap mounted on said housing at said one end thereof comprises a first end cap, and further including a second end cap mounted on said housing at an opposite end thereof, said spring means being formed integrally with said second end cap.

6. The slide bolt unit of claim 5 wherein said spring means further includes at least one narrow profile slide rail for slidably supporting said slide bolt upon displacement thereof between said advanced and retracted positions.

7. The slide bolt unit of claim 1 wherein said spring means includes at least one slide rail engaging said slide bolt with a relatively small contact surface area to provide correspondingly minimal running friction therebetween during movement of said slide bolt between said advanced and retracted positions.

8. The slide bolt unit of claim 7 wherein said spring means comprises a leaf spring.

9. A slide bolt unit for releasibly locking a door or the like in a closed position, said slide bolt unit comprising:

a housing defining an elongated slide channel;

an elongated slide bolt carried by said housing for sliding movement along said slide channel between advanced and retracted positions for respectively locking and unlocking the door;

an end cap mounted on said housing at one end thereof, said end cap defining a slide port for slide-through reception of said slide bolt;

an actuator tab carried by said slide bolt and extending laterally therefrom through a position control slot formed in said housing, said position control slot defining an elongated central slot segment extending between a pair of comparatively wider notches formed at opposite ends thereof;

said actuator tab defining at least one lock shoulder for engaging an associated one of said notches when said actuator tab is disposed at one of said opposite ends of said position control slot, to prevent slide movement of said actuator tab along said position control slot thereby to prevent displacement of said slide bolt along said slide channel between said advanced and retracted positions;

said actuator tab further defining a relatively narrow slotted track sized to permit sliding movement of said actuator tab along said central slot segment when said slotted track is aligned generally coplanar with said central slot segment, to permit sliding movement of said actuator tab along said position control slot for displacing said slide bolt along said slide channel between said advanced and retracted positions; and spring means for urging said actuator tab normally in a direction engaging said at least one lock shoulder with an associated one said notches and moving said slotted track out of alignment with said central slot segment, said actuator tab being manually operable by fingertip depression for displacement to align said slotted track thereon with said central slot segment, and for manually displacing said actuator tab along said central slot segment to slidably move said slide bolt between said advanced and retracted positions;

said spring means urging said at least one lock shoulder into sliding engagement with said housing during movement of said slide bolt between said advanced and retracted positions to provide a relatively small surface contact area with correspondingly minimal running friction therebetween;

said end cap mounted on said housing at said one end thereof comprising a first end cap, and further including a second end cap mounted on said housing at an opposite end thereof, said spring means being formed integrally with said second end cap.

10. The slide bolt unit of claim 9 wherein said actuator tab is formed integrally with said slide bolt.

11. The slide bolt unit of claim 9 wherein said spring means further includes at least one narrow profile slide rail for slidably supporting said slide bolt upon displacement thereof between said advanced and retracted positions.

12. The slide bolt unit of claim 9 wherein said actuator tab defines a pair of said lock shoulders for engaging an associated one of said notches.

13. A slide bolt unit for releasibly locking a door or the like in a closed position, said slide bolt unit comprising:

a housing defining an elongated slide channel;

an elongated slide bolt carried by said housing for sliding movement along said slide channel between advanced and retracted positions for respectively locking and unlocking the door;

an actuator tab formed integrally with said slide bolt and extending laterally therefrom through a position control slot formed in said housing, said position control slot defining an elongated central slot segment extending between a pair of comparatively wider notches formed at opposite ends thereof;

said actuator tab defining at least one lock shoulder for engaging an associated one of said notches when said actuator tab is disposed at one of said opposite ends of said position control slot, to prevent slide movement of said actuator tab along said position control slot thereby to prevent displacement of said slide bolt along said slide channel between said advanced and retracted positions;

said actuator tab further defining a relatively narrow slotted track sized to permit sliding movement of said actuator tab along said central slot segment when said slotted track is aligned generally coplanar with said central slot segment, to permit sliding movement of said actuator tab along said position control slot for displacing said slide bolt along said slide channel between said advanced and retracted positions;

a first end cap mounted on said housing at one end thereof and including integrally formed spring means for urging said actuator tab normally in a direction engaging said at least one lock shoulder with an associated one said notches and moving said slotted track out of alignment with said central slot segment, said actuator tab being manually operable for displacement to align said slotted track thereon with said central slot segment, and for manually displacing said actuator tab along said central slot segment to slidably move said slide bolt between said advanced and retracted positions; and a second end cap mounted on said housing at an opposite end thereof, said second end cap defining a slide port for slide-through reception of said slide bolt.

14. The slide bolt unit of claim 13 wherein said spring means further includes at least one narrow profile slide rail for slidably supporting said slide bolt upon displacement thereof between said advanced and retracted positions.

15. The slide bolt unit of claim 13 wherein said actuator tab defines a pair of said lock shoulders for engaging an associated one of said notches.

16. In a hinged panel adapted for movement with respect to a frame between a closed position and an open position, a slide bolt unit comprising:

a housing defining an elongated slide channel;

an elongated slide bolt carried by said housing for sliding movement along said slide channel between advanced and retracted positions for respectively locking and unlocking the panel in the closed position;

an end cap mounted on said housing at one end thereof, said end cap defining a slide port for slide-through reception of said slide bolt;

an actuator tab carried by said slide bolt and extending laterally therefrom through a position control slot formed in said housing, said actuator tab being movable between a first position engageable with said housing to prevent slide movement of said actuator tab along said position control slot to prevent displacement of said slide bolt along said slide channel, and a second position slidably movable along said position control slot for displacing said slide bolt along said slide channel between said advanced and retracted positions; and spring means for urging said actuator tab normally to said first position, said actuator tab being manually operable by fingertip depression for displacement from said first position to said second position, and for manually displacing said actuator tab while in said second position along said position control slot;

said position control slot defining an elongated central slot segment extending between a pair of comparatively wider notches formed at opposite ends thereof, and wherein said actuator tab defines at least one lock shoulder for engaging an associated one of said notches when said actuator tab is in said first position, said actuator tab further defining a relatively narrow slotted track sized to permit sliding movement of said actuator tab along said central slot segment when said actuator tab is in said second position.

17. The combination of claim 16 wherein the hinged panel defines a free side edge, said slide bolt unit being mounted along said free side edge of said hinged panel.

18. The combination of claim 17 further including a trim strip mounted onto said free side edge of said hinged panel to overlie said slide bolt unit, said actuator tab being manually accessible through an access port formed in said trim strip.

19. The combination of claim 17 wherein said slide bolt unit is mounted into a recessed channel formed in said free side edge of said hinged panel.

20. The combination of claim 16 wherein said actuator tab is formed integrally with said slide bolt.

21. The combination of claim 16 wherein said actuator tab and said housing include interfitting lock means engageable at one end of said position control slot for releasibly retaining said slide bolt in said advanced position.

22. The combination of claim 16 wherein said actuator tab defines a pair of said lock shoulders for engaging an associated one of said notches when said actuator tab is in said first position.

23. The combination of claim 16 wherein said spring means biases said actuator tab in a direction for seating said at least one lock shoulder into an associated one of said notches, said actuator tab being fingertip engageable for displacement from said first position to said second position.

24. The combination of claim 16 wherein said end cap mounted on said housing at said one end thereof comprises a first end cap, and further including a second end cap mounted on said housing at an opposite end thereof, said spring means being formed integrally with said second end cap.

25. The combination of claim 24 wherein said spring means further includes at least one narrow profile slide rail for slidably supporting said slide bolt upon displacement thereof between said advanced and retracted positions.

26. The combination of claim 16 further including a ported keeper plate mounted on the frame for slidably receiving said slide bolt in said advanced position.

27. The combination of claim 16 wherein the hinged panel comprises a semi-active door of a double door entry set.

28. The slide bolt unit of claim 16 wherein said spring means urges said at least one lock shoulder into sliding engagement with said housing during movement of said slide bolt between said advanced and retracted positions to provide a relatively small surface contact area with correspondingly minimal running friction therebetween.

29. The slide bolt unit of claim 16 wherein said spring means includes at least one slide rail engaging said slide bolt with a relatively small contact surface area to provide correspondingly minimal running friction therebetween during movement of said slide bolt between said advanced and retracted positions.

30. The slide bolt unit of claim 29 wherein said spring means comprises a leaf spring.

31. In a hinged panel set including at least first and second hinged panels each movable with respect to a common frame between closed and open positions, with said first hinged panel having a free side edge exposed for access when said second hinged panel is in the open position and inaccessible when said first and second hinged panels are in the closed position, a slide bolt unit comprising:

a housing recess-mounted in the free side edge of the first hinged panel, said housing defining an elongated slide channel, an elongated slide bolt carried by said housing for sliding movement along said slide channel between advanced and retracted positions for respectively locking and unlocking the first hinged panel in the closed position;

an end cap mounted on said housing at one end thereof, said end cap defining a slide port for slide-through reception of said slide bolt;

an actuator tab carried by said slide bolt and extending laterally there from through a position control slot formed in said housing, said actuator tab being exposed at the free side edge of the first hinged panel when said free side edge thereof is exposed for access, said actuator tab being movable between a first position engageable with said housing to prevent slide movement of said actuator tab along said position control slot to prevent displacement of said slide bolt along said slide channel, and a second position slidably movable along said position control slot for displacing said slide bolt along said slide channel between said advanced and retracted positions; and spring means for urging said actuator tab normally to said first position, said actuator tab being manually operable by fingertip depression for displacement from said first position to said second position, and for manually displacing said actuator tab while in said second position along said position control slot for movably displacing said slide bolt between said advanced and retracted positions;

said position control slot defining an elongated central slot segment extending between a pair of comparatively wider notches formed at opposite ends thereof, and wherein said actuator tab defines at least one lock shoulder for engaging an associated one of said notches when said actuator tab is in said first position, said actuator tab further defining a relatively narrow slotted track sized to permit sliding movement of said actuator tab along said central slot segment when said actuator tab is in said second position, and further wherein said spring means urges said at least one lock shoulder into sliding engagement with said housing during movement of said slide bolt between said advanced and retracted positions to provide a relatively small surface contact area with correspondingly minimal running friction therebetween.

32. The combination of claim 31 wherein said actuator tab is recess-mounted in the free side edge of the first hinged panel.

33. The slide bolt unit of claim 31 wherein said spring means includes at least one slide rail engaging said slide bolt with a relatively small contact surface area to provide correspondingly minimal running friction therebetween during movement of said slide bolt between said advanced and retracted positions.

34. The slide bolt unit of claim 33 wherein said spring means comprises a leaf spring.

35. The slide bolt unit of claim 31 wherein said end cap mounted on said housing at said one end thereof comprises a first end cap, and further including a second end cap mounted on said housing at an opposite end thereof, said spring means being formed integrally with said second end cap.

36. A slide bolt unit for releasibly locking a door or the like in a closed position, said slide bolt unit comprising:

a housing defining an elongated slide channel;

an elongated slide bolt carried by said housing for sliding movement along said slide channel between advanced and retracted positions for respectively locking and unlocking the door;

an actuator tab carried by said slide bolt and extending laterally therefrom through a position control slot formed in said housing, said actuator tab being movable between a first position engageable with said housing to prevent slide movement of said actuator tab along said position control slot to correspondingly prevent displacement of said slide bolt along said slide channel, and a second position slidably movable along said position control slot for displacing said slide bolt along said slide channel between said advanced and retracted positions; and spring means for urging said actuator tab normally to said first position, said actuator tab being manually operable by fingertip depression for displacement from said first position to said second position, and for manually displacing said actuator tab while in said second position along said position control slot;

said spring means slidably supporting said slide bolt upon displacement thereof between said advanced and retracted positions;

said spring means further including at least one narrow profile slide rail for slidably supporting said slide bolt upon displacement thereof between said advanced and retracted positions.

37. The slide bolt unit of claim 36 further including an end cap mounted on said housing at one end thereof, said spring means being formed integrally with said end cap.

38. A slide bolt unit for releasibly locking a door or the like in a closed position, said slide bolt unit comprising:

a housing defining an elongated slide channel;

an elongated slide bolt carried by said housing for sliding movement along said slide channel between advanced and retracted positions for respectively locking and unlocking the door;

an actuator tab carried by said slide bolt and extending laterally therefrom through a position control slot formed in said housing, said position control slot defining an elongated central slot segment extending between a pair of comparatively wider notches formed at opposite ends thereof;

said actuator tab defining at least one lock shoulder for engaging an associated one of said notches when said actuator tab is disposed at one of said opposite ends of said position control slot, to prevent slide movement of said actuator tab along said position control slot thereby to prevent displacement of said slide bolt along said slide channel between said advanced and retracted positions;

said actuator tab further defining a relatively narrow slotted track sized to permit sliding movement of said actuator tab along said central slot segment when said slotted track is aligned generally coplanar with said central slot segment, to permit sliding movement of said actuator tab along said position control slot for displacing said slide bolt along said slide channel between said advanced and retracted positions; and spring means for urging said actuator tab normally in a direction engaging said at least one lock shoulder with an associated one said notches and moving said slotted track out of alignment with said central slot segment, said actuator tab being manually operable by fingertip depression for displacement to align said slotted track thereon with said central slot segment, and for manually displacing said actuator tab along said central slot segment to slidably move said slide bolt between said advanced and retracted positions;

said spring means urging said at least one lock shoulder into sliding engagement with said housing during movement of said slide bolt between said advanced and retracted positions to provide a relatively small surface contact area with correspondingly minimal running friction therebetween;

said spring means slidably supporting said slide bolt upon displacement thereof between said advanced and retracted positions;

said spring means further including at least one narrow profile slide rail for slidably supporting said slide bolt upon displacement thereof between said advanced and retracted positions.

39. The slide bolt unit of claim 38 further including an end cap mounted on said housing at one end thereof, said spring means being formed integrally with said end cap.

40. In a hinged panel adapted for movement with respect to a frame between a closed position and an open position, a slide bolt unit comprising:

a housing defining an elongated slide channel;

an elongated slide bolt carried by said housing for sliding movement along said slide channel between advanced and retracted positions for respectively locking and unlocking the panel in the closed position;

an actuator tab carried by said slide bolt and extending laterally therefrom through a position control slot formed in said housing, said actuator tab being movable between a first position engageable with said housing to prevent slide movement of said actuator tab along said position control slot to prevent displacement of said slide bolt along said slide channel, and a second position slidably movable along said position control slot for displacing said slide bolt along said slide channel between said advanced and retracted positions; and spring means for urging said actuator tab normally to said first position, said actuator tab being manually operable by fingertip depression for displacement from said first position to said second position, and for manually displacing said actuator tab while in said second position along said position control slot;

said spring means slidably supporting said slide bolt upon displacement thereof between said advanced and retracted positions;

said spring means further including at least one narrow profile slide rail for slidably supporting said slide bolt upon displacement thereof between said advanced and retracted positions.

41. The slide bolt unit of claim 40 further including an end cap mounted on said housing at one end thereof, said spring means being formed integrally with said end cap.

42. In a hinged panel set including at least first and second hinged panels each movable with respect to a common frame between closed and open positions, with said first hinged panel having a free side edge exposed for access when said second hinged panel is in the open position and inaccessible when said first and second hinged panels are in the closed position, a slide bolt unit comprising:

a housing recess-mounted in the free side edge of the first hinged panel, said housing defining an elongated slide channel;

an elongated slide bolt carried by said housing for sliding movement along said slide channel between advanced and retracted positions for respectively locking and unlocking the first hinged panel in the closed position;

an actuator tab carried by said slide bolt and extending laterally therefrom through a position control slot formed in said housing, said actuator tab being exposed at the free side edge of the first hinged panel when said free side edge thereof is exposed for access, said actuator tab being movable between a first position engageable with said housing to prevent slide movement of said actuator tab along said position control slot to prevent displacement of said slide bolt along said slide channel, and a second position slidably movable along said position control slot for displacing said slide bolt along said slide channel between said advanced and retracted positions; and spring means for urging said actuator tab normally to said first position, said actuator tab being manually operable by fingertip depression for displacement from said first position to said second position, and for manually displacing said actuator tab while in said second position along said position control slot for movably displacing said slide bolt between said advanced and retracted positions;

said spring means slidably supporting said slide bolt upon displacement thereof between said advanced and retracted positions;

said spring means further including at least one narrow profile slide rail for slidably supporting said slide bolt upon displacement thereof between said advanced and retracted positions.

43. The slide bolt unit of claim 42 further including an end cap mounted on said housing at one end thereof, said spring means being formed integrally with said end cap.

* * * * *